US005379488A

United States Patent [19]

Stahlecker

[11] Patent Number: 5,379,488

[45] Date of Patent: Jan. 10, 1995

[54] SLIVER GUIDING ARRANGEMENT FOR DRAFTING UNITS OF SPINNING MACHINES

[75] Inventor: Fritz Stahlecker, Bad Überkingen, Germany

[73] Assignee: Hans Stahlecker, Germany; a part interest

[21] Appl. No.: 80,773

[22] Filed: Jun. 24, 1993

[30] Foreign Application Priority Data

Aug. 20, 1992 [DE] Germany ..... 4227492

[51] Int. Cl.[6] ..... D01H 5/72

[52] U.S. Cl. ..... 19/287; 19/236

[58] Field of Search ..... 19/236, 243, 246, 282, 19/287, 288; 57/315, 328, 352

[56] References Cited

U.S. PATENT DOCUMENTS

| | | | |
|---|---|---|---|
| 1,448,162 | 3/1923 | Butler | 19/287 |
| 1,668,333 | 5/1928 | Oxley | 19/287 |
| 1,838,483 | 12/1931 | Helland | 19/287 |
| 2,252,546 | 8/1941 | Blake | 19/287 |
| 2,422,444 | 6/1947 | Solanas | 19/287 |
| 3,136,006 | 6/1964 | Mackie | 19/287 X |
| 4,870,720 | 10/1989 | Nickolay et al. | 19/288 |

FOREIGN PATENT DOCUMENTS

| | | | |
|---|---|---|---|
| 907274 | 3/1954 | Germany . | |
| 9140 | of 1900 | United Kingdom | 19/287 |

*Primary Examiner*—Clifford D. Crowder
*Assistant Examiner*—John J. Calvert
*Attorney, Agent, or Firm*—Evenson, McKeown, Edwards & Lenahan

[57] ABSTRACT

A sliver guiding arrangement for drafting units of spinning machines is provided with forcibly traversing sliver guides. Two sliver guides respectively which are assigned to adjacent slivers and which are connected in front of a wedge-shaped gap of a clamping roller pair, are connected with one another by a coupling member to form one structural member. The coupling member is driven via a driving device by a traversing rod to carry out traversing movements. The driving device, which bridges a distance between the traversing rod and the coupling member, is movable relative to the coupling member in the direction of the wedge-shaped gap. The structural member, which includes the sliver guides, is guided in parallel to the wedge-shaped gap on a sliding surface.

20 Claims, 6 Drawing Sheets

SLIVER GUIDING ARRANGEMENT FOR DRAFTING UNITS OF SPINNING MACHINES

BACKGROUND AND SUMMARY OF THE INVENTION

The present invention relates to a sliver guiding arrangement for drafting units of spinning machines, comprising at least two sliver guides which are assigned to adjacent slivers, are connected in front of a wedge-shaped gap of a clamping roller pair and are connected with one another to form a structural member by means of a coupling member which is driven via a driving device by means of a traversing rod to carry out traversing movements.

A sliver guiding arrangement is shown in German Patent Document DE-PS 907 274. In this arrangement, two adjacent sliver guides respectively are firmly connected with one another by a connecting strip. Two clamping springs originate from the connecting strip whose spring arms are constructed such that they clamp a drivable traversing rod of the spinning machine between one another. The connecting strip is therefore directly connected with the traversing rod. The individual sliver guides project into the wedge-shaped gap of a clamping roller pair which follows, without coming in contact with the individual rollers.

In drafting units with very high drafts, as they are required, for example, in ring spinning machines which spin drafting frame slivers fed in cans directly into yarns, it is necessary that the sliver guides be a defined distance from the clamping roller pair which follows. This distance is to be as independent as possible from possible tolerances of the traversing rod which extends through the whole machine.

An object of the present invention is to provide a sliver guiding arrangement having a traversing rod, in which the distance of the sliver guides to the clamping roller pair which follows is defined, and in which the position of the sliver guides can be determined in a precise manner independently of the traversing rod.

This and other objects are achieved by the present invention which provides that the driving device, which bridges a distance between the traversing rod and the coupling member, is arranged in the direction of the wedge-shaped gap in a movable manner relative to the coupling member, and in that the structural member is guided on a slideway in parallel to the wedge-shaped gap.

Because of the fact that a distance is provided between the traversing rod and the coupling member of the sliver guides which is bridged by a driving device which can be moved relative to the coupling member, differences in distance may be compensated. As a result of the fact the structural member is also guided in parallel to the wedge-shaped gap on a sliding surface, a defined distance exists between the sliver guides and the clamping roller pair which follows. Possibly, this defined distance may have a zero value.

The clamping of the slivers by the clamping roller pair does not impair the traversing of the slivers because the traversing takes place very slowly. It is sufficient, for example, to carry out a complete traversing movement only once an hour. Despite this very slow traversing movement, the coatings of the pressure rollers of the drafting units as well as the aprons of apron guides are sufficiently protected from premature wear.

In certain embodiments of the invention, the sliding surface is formed by a guide rail which is arranged at a distance from the clamping roller pair. Such a guide rail, which may be identical, for example, with the so-called reversing table of bottom aprons, can be aligned very precisely with respect to the wedge-shaped gap.

In other embodiments of the invention, the sliding surface may be formed by at least one roller of the clamping roller pair. This necessarily achieves the required precision of the distance of the sliver guides from the clamping roller pair.

In certain embodiments of the invention, the sliding surface is constructed as a stop against which the structural member will be placed. Regardless of whether this is a guide rail or a roller of the clamping roller pair, the stop permits a positioning of the structural member and thus of the sliver guides that is free of play at any time. By means of the transport of the slivers, the structural member pulls it itself against the stop.

When a roller of the clamping roller pair is used as the stop, as in certain embodiments, it is expedient for the coupling member to be provided with at least two spacing webs which are placed against the roller. As a result, the structural member is aligned very precisely with respect to the clamping roller pair without the requirement that the sliver guides themselves must pull completely into the wedge-shaped gap.

Advantageously, the driving device is arranged between two sliver guides and is non-slidably fastened to the traversing rod, in certain embodiments. For transmitting the traversing movements, the driving device expediently has lateral guides. These lateral guides may be arranged on a tongue-type bracket of the driving device, in which case the bracket engages in a recess of the coupling member. By means of these measures, it is ensured that the coupling member is arranged largely perpendicularly with respect to the traversing rod and in that, even in the case of slight deviation from the perpendicularity, the traversing movements are transmitted without any impairment of the parallelism of the coupling member with respect to the clamping roller pair.

In an advantageous embodiment, the driving device is constructed as a leaf spring. This has the additional advantage that the driving device can be placed on the guide rail with a slight contact pressure, whereby the level of the sliver guides with respect to the so-called drafting zone plane can be determined in a precise manner. In addition, if necessary, the leaf spring can apply the axial force in order to place the structural member against the stop.

In another embodiment of the invention, several coupling members are assigned to a single driving device. This results in a reduction of the manufacturing expenditures.

Furthermore, in certain embodiments, the driving device held on the traversing rod such that it can be folded away. In particular, it may be advantageous to fold all driving devices upward, for example, when the bottom cylinders of drafting units which extend through the machine are to be removed.

Other objects, advantages and novel features of the present invention will become apparent from the following detailed description of the invention when considered in conjunction with the accompanying drawings.

DETAILED DESCRIPTION OF THE DRAWINGS

Figure 1:
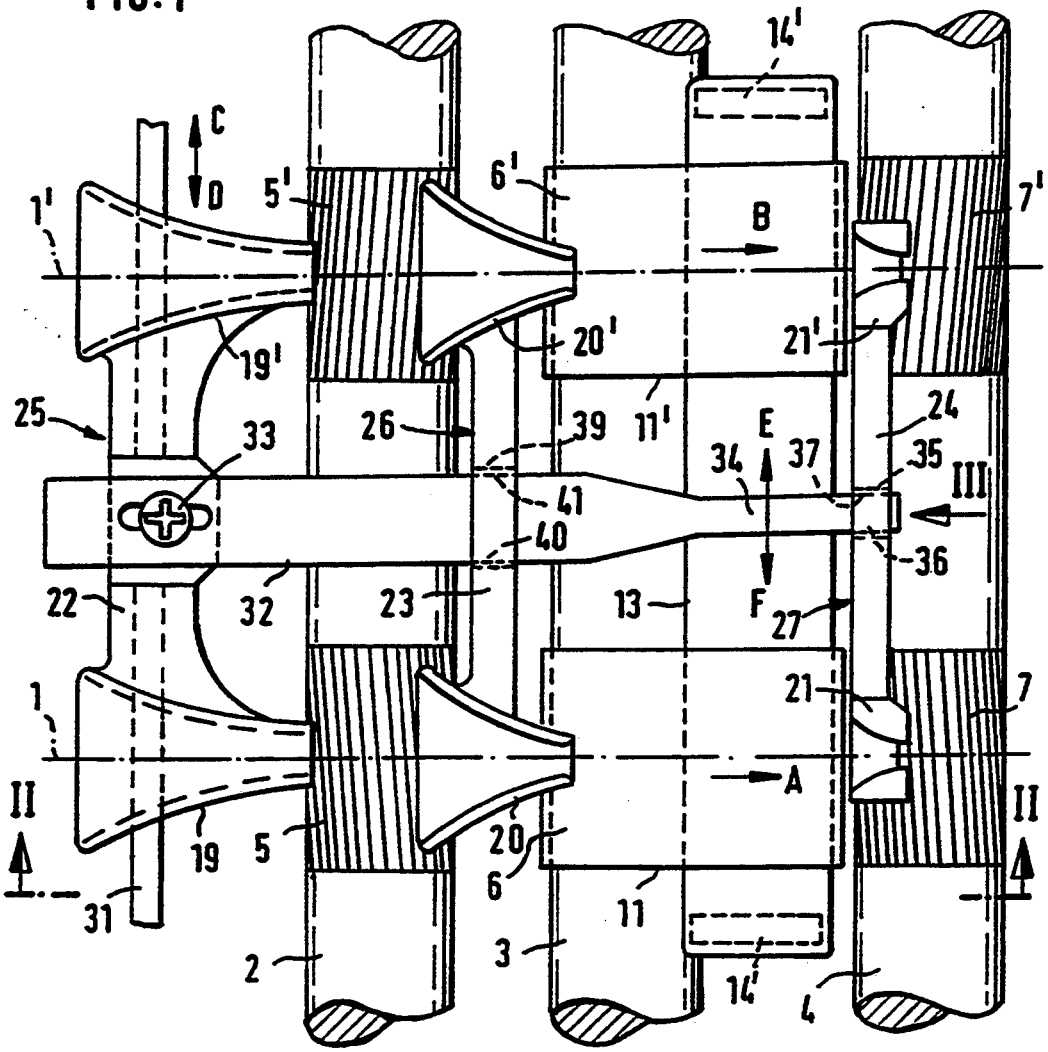
FIG. 1 is a top view of a sliver guiding arrangement constructed according to an embodiment of the present invention in which the driving device is a leaf spring.
Figure 2:
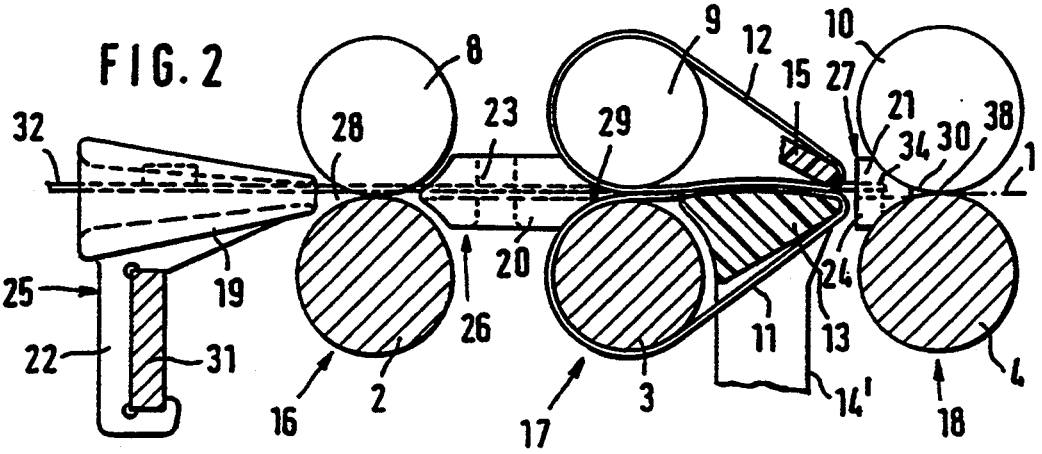
FIG. 2 is a sectional view along sectional plane II—II of FIG. 1, in which, in comparison to the embodiment of FIG. 1, pressure rollers belonging to the drafting unit are added.

The sliver guiding arrangement according to FIGS. 1 and 2 is described for a three-cylinder drafting unit of a ring spinning machine. In particular, a drafting unit is considered which comprises loading carriers that are arranged in the center and are not shown and which have pressure roller twins, as they are customarily used in practice. Such pressure roller twins jointly load two adjacent slivers 1 and 1' which are shown by a dash-dotted line.

In a known manner, the drafting unit comprises three bottom cylinders 2, 3 and 4 which extend through in the longitudinal direction of the machine and are driven from a driving head of the spinning machine. In the area of the slivers 1, 1', the bottom cylinders 2, 3 and 4 each have diagonally knurled or fluted bottom rollers 5 and 5', 6 and 6' as well as 7 and 7'. The pressure roller twins 8, 9 and 10 which are shown only in FIG. 2 are assigned to the bottom cylinders 5, 5', 6, 6', 7, 7' in a known manner. The slivers 1 and 1' are transported through the drafting unit in the direction of the arrows A and B and in the process are drafted to the desired yarn size.

For a better guiding of the slivers 1, 1' to be drafted, guiding aprons are used, of which two lower guiding ("bottom") aprons 11 and 11' wind around the bottom rollers 6 and 6', and upper aprons 12 wind around the pertaining pressure rollers of the pressure roller twin 9. For the deflection of the bottom aprons 11, 11' in the area of the bottom rollers 7, 7', a guide rail 13 is used which advantageously extends along two spinning stations and is therefore assigned jointly to slivers 1 and 1'. Outside the bottom aprons 11, 11', the guide rail 13 is held on two holders 14 and 14' which, in turn, in a manner that is not shown, are mounted on a longitudinal rail of the spinning machine. The top aprons 12 are deflected in the area of the pressure roller twin 10 by means of a top apron cradle 15 which is supported against a stop (not shown) of the guide rail 13.

Sliver guides 19, 19' are provided for each sliver 1 and 1', in each case directly in front of a clamping roller pair 16, 17 and 18. The sliver guides 19 and 19' are provided in front of the feeding clamping roller pair 16 which is formed by the bottom rollers 5, 5' and the pressure roller twin 8. Sliver guides 20 and 20' are provided in front of the center clamping roller pair 17 which is formed by the bottom rollers 6 and 6' and the pressure roller twin 9. Finally, sliver guides 21 and 21' are provided in front of the delivery clamping roller pair 18 which is formed by the bottom rollers 7 and 7' as well as the pressure roller twin 10.

Sliver guides 19 and 19', 20 and 20' as well as 21 and 21' are connected with one another to form one structural member 25, 26, and 27 respectively by means of coupling members 22, 23 and 24. One so-called twin condenser is therefore provided in front of each wedge-shaped gap 28, 29 and 30 of the clamping roller pairs 16, 17 and 18.

Particularly when yarns of very fine sizes are spun, it is advantageous for the sliver guides 19 and 19', 20 and 20' as well as 21 and 21' to be driven to carry out very slow traversing movements. This means that in the present case the structural members 25, 26 and 27 will all traverse together. However, this traversing movement is very slow; it takes place, for example, only a few times an hour.

The traversing movement-originates from a traversing rod 31 which extends through in the longitudinal direction of the machine and is driven from the driving head of the spinning machine to carry out traversing movements corresponding to the directions of the arrows C and D. The structural member 25, which connects the sliver guides 19 and 19' that are provided in front of the clamping roller pair 16, is clamped directly by the coupling member 22 onto the traversing rod 31 and therefore goes directly along in the traversing movements in the directions of the arrows C and D. Because of the slow traversing movements, the clamping of the slivers 1 and 1' by the clamping roller pair 16 is harmless.

The traversing rod 31 has a fairly large distance to the coupling members 23 and 24. This distance is bridged by a driving device 32 which is arranged on the structural member 25 by means of a fastening device 33 non-displaceably located in the center between the sliver guides 19 and 19', 20 and 20' as well as 21 and 21'. In the embodiment of FIG. 1, the driving device 32 is constructed as a leaf spring. On its side facing away from the traversing rod 31, the driving device 32 has a tongue-type bracket 34 which, because of the elastic spring effect, rests on the guide rail 13 with a slight contact pressure. The bracket 34 is fitted through a recess 35 of the coupling member 24 constructed as an opening. The recess 35 is assigned to the lateral guides 36 and 37 of the bracket 34 with little play. In contrast, in the direction of the wedge-shaped gap 30 of the delivery clamping roller pair 18, the driving device 32 is freely movable with respect to the coupling member 24.

As a result of their transport, the slivers 1 and 1' move the sliver guides 21 and 21' into the wedge-shaped gap 30 of the delivery clamping roller pair 18. The sliver guides 21 and 21' are therefore supported on the bottom rollers 7 and 7' as well as on the pressure roller twin 10 as the stop. At the same time, the delivery clamping roller pair 18 forms a sliding surface for the structural member 27 in parallel to the wedge-shaped gap 30.

Because of this measure, it is first achieved that the coupling member 24 is traversed exactly in parallel to the delivery clamping roller pair 18. Furthermore, because of the stop against the delivery clamping roller pair 18, there is a no-play guiding so that the distance of the sliver guides 21 and 21' from the nip line 38 of the clamping roller pair 18 is very precise. Finally, because of the slight contact pressure of the bracket 34 against the guide rail 13, it is ensured that the sliver guides 21 and 21' are precisely adjusted in their height with respect to the drafting zone plane. The drafting zone plane is defined by the connection of the nip lines of the roller pairs 16, 17 and 18.

Analogously, the structural member 26 comprising the sliver guides 20 and 20' is guided on the driving device 32 by means of a recess 39. The sliver guides 20 and 20' also pull into the wedge-shaped gap 29 of the center clamping roller pair 17, whereby the sliver guides 20 and 20' also are aligned in a precise manner. The driving device 32 also drives the structural member 26 by way of its lateral guides 40 and 41 to carry out slow traversing movements.

As the result of the fastening device 33, it is possible to adjust the distance of the traversing rod 31 and thus of the sliver guides 19 and 19' with respect to the other sliver guides 20 and 20' as well as 21 and 21' when the feeding clamping roller pair 16 is adjusted in its distance with respect to the other clamping roller pairs 17 and 18. For the removal of the twin condenser, the driving device 32 is slightly lifted. It may be very thin because it is stressed only in the lateral direction. Correspondingly, the driving device 32 may be bent in the upward direction, particularly when it is constructed as a leaf spring.

The sliver guiding arrangement according to FIGS. 1 and 2 therefore makes it possible to let all sliver guides 19 and 19', 20 and 20' as well as 21 and 21' traverse in a forced manner without any erratic running of particularly the sliver guides 21 and 21' pertaining to the main drafting zone of the drafting unit. The exact position is determined by the clamping roller pair 18. The bracket 34 defines the position in the lateral direction. Unacceptable bouncing movements are effectively prevented. The traversing movement C—D of the traversing rod 31 is transmitted by way of the driving device 32 to the structural members 26 and 27; see double arrow E and F.

Figure 3:
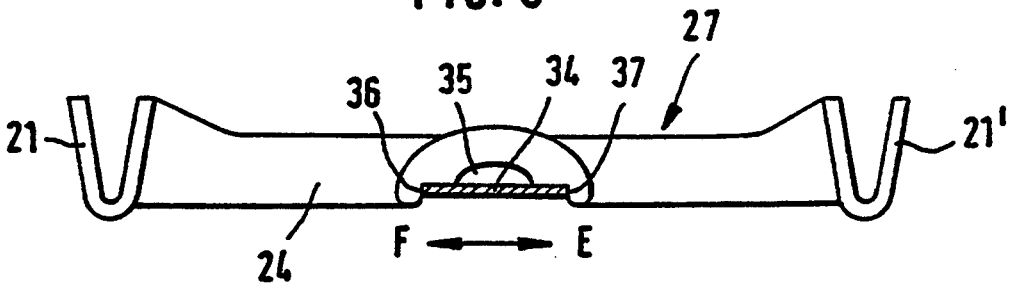
FIG. 3 is a view in the direction of the arrow III of FIG. 1 of an embodiment of a structural member formed of two sliver guides and a coupling member.

FIG. 3 illustrates for an embodiment of the invention how the structural member 27 consisting of the sliver guides 21 and 21' and the coupling member 24 may be constructed with respect to the recess 35 for the bracket 34 of the driving device 32. The lateral guides 36 and 37 of the bracket 34 are shown, whereby the traversing movements are caused in the direction of the double arrow E—F. At the same time, as explained above, the bracket 34 is placed with a slight contact pressure against the guide rail 13, whereby the height of the bracket 34 can also be determined in a precise manner.

Figure 4:
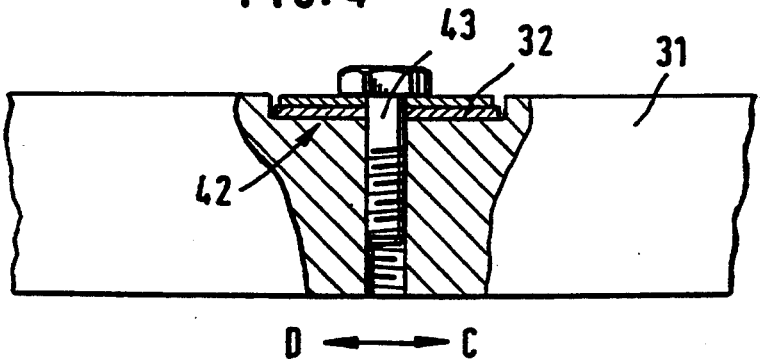
FIG. 4 is a view in the direction of arrow III of FIG. 1 of an embodiment of a fastening of a driving device on a traversing rod which deviates from FIG. 1.

FIG. 4 shows an embodiment illustrating how the driving device 32 can be fastened directly on the traversing rod 31, which therefore is not indirectly fastened by way of the structural member 24, as in the embodiment of FIGS. 1 and 2. For achieving a sufficient perpendicularity between the driving device 32 and the traversing rod 31, a small recess 42 may be milled in the traversing rod 31. The driving device 32, which is constructed as a leaf spring, rests in this recess 42 and is secured by a screw 43. As a result, the driving device 32 is driven according to the directions of the arrows C and D to perform traversing movements.

Figure 5:
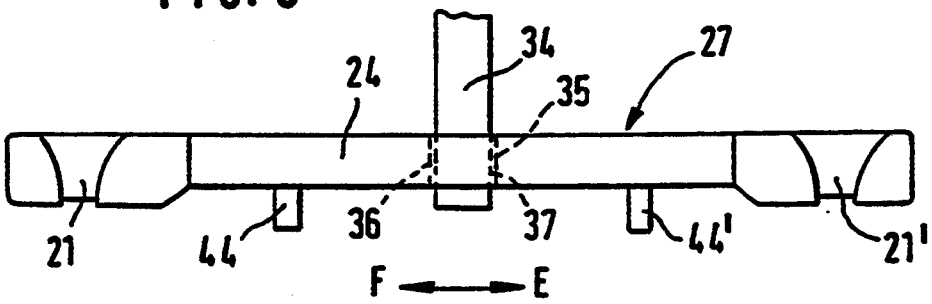
FIG. 5 is a partial view similar to FIG. 1 of an embodiment of a coupling member with two spacing webs which connect two sliver guides, the coupling member being turned by 90 degrees in comparison to FIG. 1.

Deviating from the previously described embodiments, structural member 27, which is assigned to the delivery clamping roller pair 18, according to the embodiment of FIG. 5, has spacing webs 44 to 44'. These project slightly beyond the actual sliver guides 21 and 21' in the direction of the wedge-shaped gap 30. During the spinning, the sliver guides 21 and 21' are pulled in the direction of the wedge-shaped gap 30 but remain at a slight distance from the bottom rollers 7 and 7' and the pressure roller twin 10 because the spacing webs 44 and 44' are supported against the clamping roller pair 18. These spacing webs 44, 44' may be provided with approximately the shape of the wedge-shaped gap 30, as the sliver guides 21, 21' have a triangular shape. The spacing webs 44 and 44' prevent the sliver guides 21, 21' themselves from having contact with the clamping roller pair 18.

It is advantageous for the spacing webs 44, 44' not to run directly on the fluting of the bottom rollers 7, 7' but in the smooth area of the bottom cylinder 4 situated in-between. There is therefore no danger that the slivers 21, 21' will run erratically. In this case, the sliding surface is formed between the spacing webs 44, 44' and the clamping roller pair 18.

In other embodiments, the spacing webs 44 and 44' are mounted outside the sliver guides 21 and 21' whereby the guiding base for the structural member 27 will be enlarged.

Figure 6:
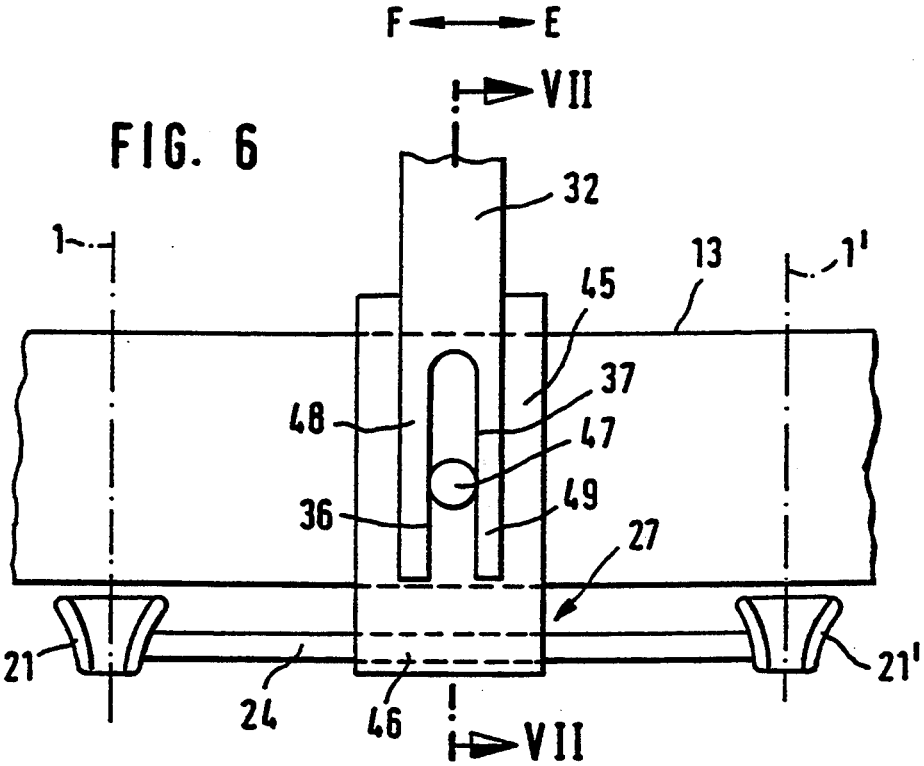
FIG. 6 is a view similar to FIG. 5 of an embodiment of a coupling member which is connected with a holder sliding on a guide rail.
Figure 7:
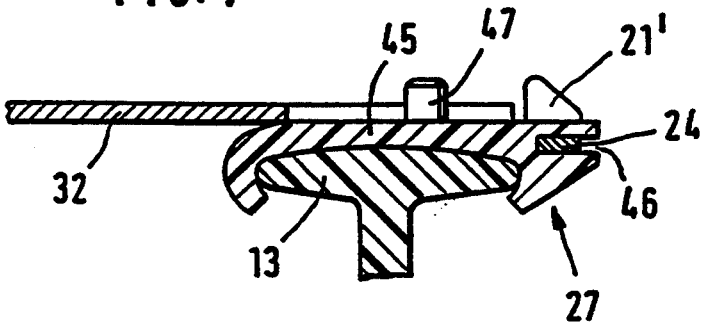
FIG. 7 is a sectional view along sectional plane VII—VII of FIG. 6, in which the coupling member is turned by 90 degrees.

In the embodiment according to FIGS. 6 and 7, the structural member 27, in addition to the sliver guides 21 and 21' and the coupling member 24, also has a holder 45 which is firmly connected with the coupling member 24. The holder 45 is threaded onto the guide rail 13 and can be moved in the lateral direction corresponding to the directions of the arrows E and F by means of the driving device 32. In the forward area, the holder 45 has a recess 46 extending in the longitudinal direction into which the coupling member 24 is clipped. For this purpose, the coupling member 24 preferably has a rectangular cross-section.

The holder 45 always remains in the drafting unit and is suitable for receiving different sliver guides 21, 21'. The holder 45 has an extension 47 around which the driving device 32, which traverses corresponding to the directions of the arrows E and F, reaches by means of fork-shaped extensions 48 and 49. Also in this embodiment, the coupling member 24 can be moved freely in the direction of the wedge-shaped gap 30 relative to the driving device 32 but is guided in the lateral direction by the lateral guides 36 and 37.

In the embodiment of FIGS. 6 and 7, it is not necessary for the sliver guides 21, 21' to be pulled completely into the wedge-shaped gap 30 of the delivery clamping roller pair 18. On the contrary, the guide rail 13, which extends in parallel to the wedge-shaped gap 30, is used in this case as the sliding surface for the holder 45.

Figure 8:
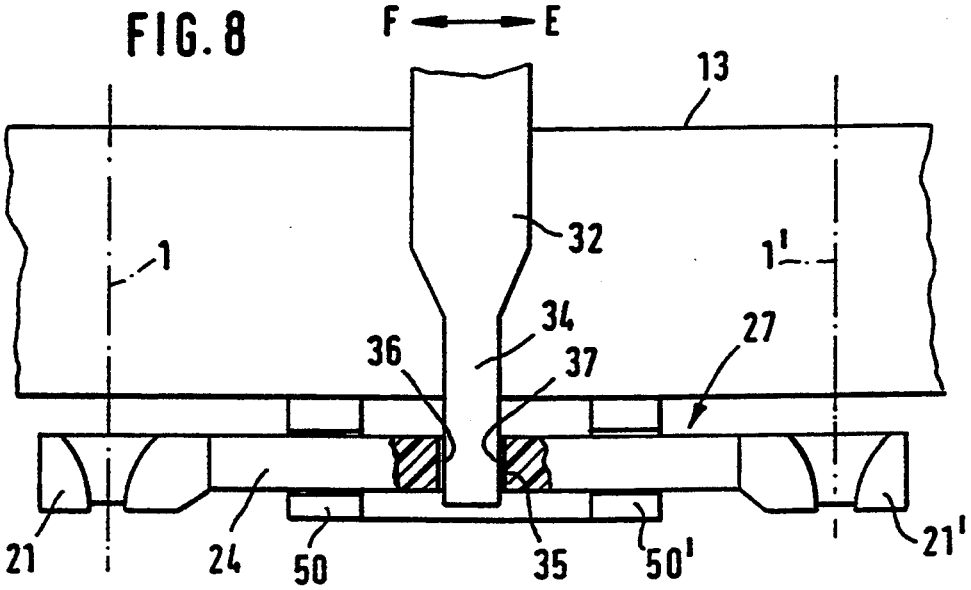
FIG. 8 is a view similar to FIG. 6, of an embodiment in which the coupling member is pressed against a stop of the guide rail.

In the embodiment according to FIG. 8, the guide rail 13 also forms the sliding surface for the structural member 27 which comprises the sliver guides 21, 21' and the coupling member 24. In this case, the guide rail 13 has guiding extensions 50 and 50' which are used as a stop for the coupling member 24. The force directed against the stop is applied by the slivers 1 and 1' when these move by means of the sliver guides 21 and 21'. The bracket 34 of the driving device 32 only has the task of providing, by means of the lateral guides 36 and 37, the structural member 27 with traversing movements corresponding to the directions of the arrows E and F. Because the guiding extensions 50 and 50' are separated by a sufficiently large distance from one another, a sufficient parallelism of the coupling member 24 with respect to the clamping roller pair 18 is ensured. There can be no unacceptable rotating of the actual sliver guides 21 and 21' because the coupling member 24 has a rectangular cross-section.

As an alternative which deviates from FIG. 8, it is possible to machine, instead of the guiding extensions 50 and 50', oblong holes into the guide rail 13 in which extensions of the coupling member 24 are guided.

Although the development according to the invention was described mainly in connection with the sliver guides 21 and 21' assigned to the clamping roller pair 18, analogous constructions are expedient for the sliver guides 20 and 20' pertaining to the center clamping roller pair 17.

Figure 9:
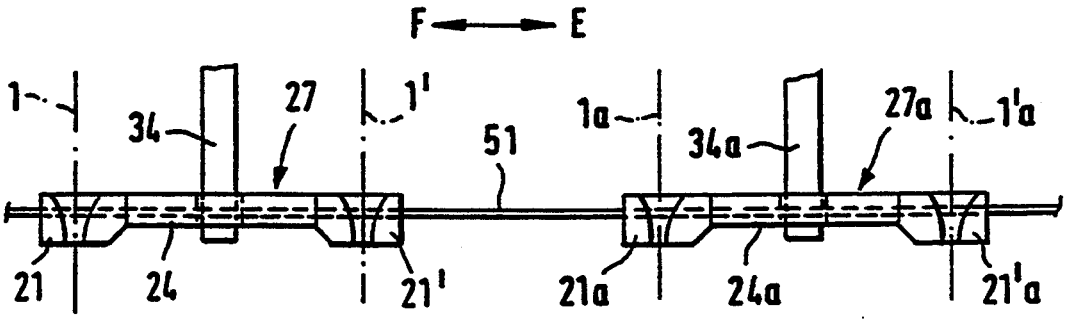
FIG. 9 is a view of similar to FIG. 8, of an embodiment in which several coupling members are threaded onto a profile wire extending in parallel to the wedge-shaped gap.

In the construction according to FIG. 9, two adjacent structural members 27 and **27*a* are illustrated which are assigned to a total of four adjacent slivers 1 and 1' as well as 1*a* and 1'*a*. As in the previously described embodiments, structural member 27 has two adjacent sliver guides 21 and 21' as well as the coupling member 24. In a corresponding manner, the structural member 27*a* comprises the two sliver guides 21*a* and 21'*a* as well as the coupling member 24*a***.

The two adjacent structural members 27 and **27*a*, (and possibly further identical structural members, which are not shown) are threaded onto a profile wire 51 which extends along a plurality of spinning stations. This profile wire 51 may in each case be fastened on the customarily existing bottom cylinder stands, which are not shown, specifically in such a manner that it is well tensioned. It is possible, if required, to pull the profile wire 51 through the whole spinning machine. It may be tensioned at one machine end so that it extends exactly straight and in parallel to the wedge-shaped gap 30**.

In certain embodiments of the invention, the threading of the structural members 27, **27*a* onto the profile wire 51 takes place in such a manner that the structural members 27, 27*a*** can be fitted on by means of a clipped connection from the outside and can be removed when required.

Figure 10:
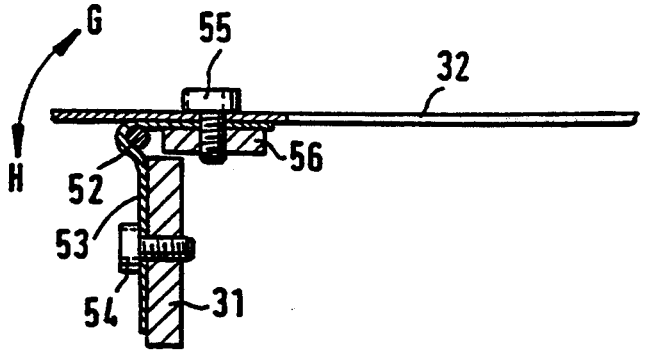
FIG. 10 is a partial view similar to FIG. 2 of the area of the traversing rod with a driving device which can be folded away.

In FIG. 10, an embodiment is illustrated in which the driving device 32 is fastened so that it can be folded away corresponding to the directions of the arrows G and H. A joint 52 is provided for this purpose. This fastening prevents the driving devices 32 comprising a leaf spring from bending during a rough operation. In particular, when the bottom cylinders 2, 3 and 4 are removed, it is expedient that the driving device 32 can be folded away upwards.

The hinge 53 for the joint 52, is fastened to the traversing rod 31 by means of a screw 54, and is also fastened on the driving device 32 by means of a screw 55. For the screw 55, an additional plate 56 may be provided for a more stable fastening.

As mentioned above, the tongue-type bracket 34 of the driving device 32 rests with a slight contact pressure on the guide rail 13. For this reason, the joint 52 is designed such that a low rotational force always exists in the direction of the guide rail 13. Furthermore, a detent is provided for the folded-open position so that the driving device 32 cannot automatically move back into the operating position.

Figure 11:
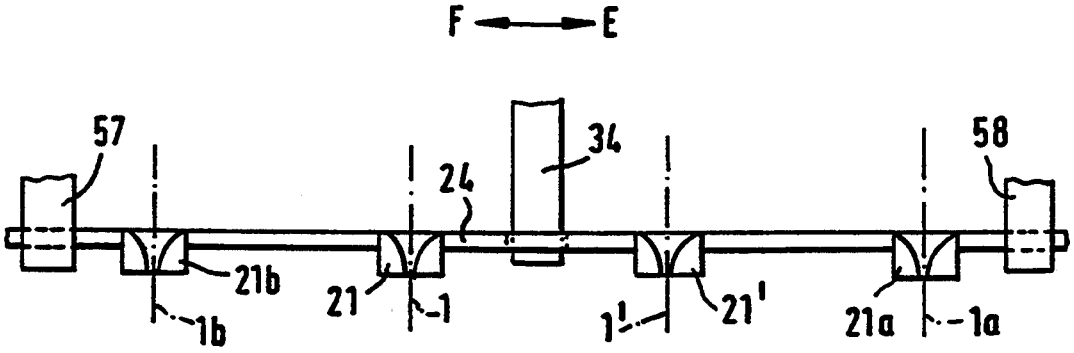
FIG. 11 is a view similar to FIG. 9, of an embodiment in which a driving device is assigned to a plurality of sliver guides.

FIG. 11 shows a solution according to which a plurality of adjacent sliver guides 21 and 21' as well as **21*a* and 21*b* are combined to form a unit. In this case, the coupling member 24 connects at least the mentioned sliver guides 21, 21', 21*a* and 21*b*. These are in each case assigned to a sliver 1, 1', 1*a* and 1*b***.

The coupling member 24 for all mentioned and possibly additional sliver guides can be driven by the bracket 34 of a coramon driving device 32 corresponding to the direction of the arrows E and F to carry out traversing movements. As a result, the manufacturing expenditures can be minimized further. The coupling member 24 is slidingly held in guiding extensions 57 and 58, which are only outlined, of a guide rail which is not shown.

Figure 12:
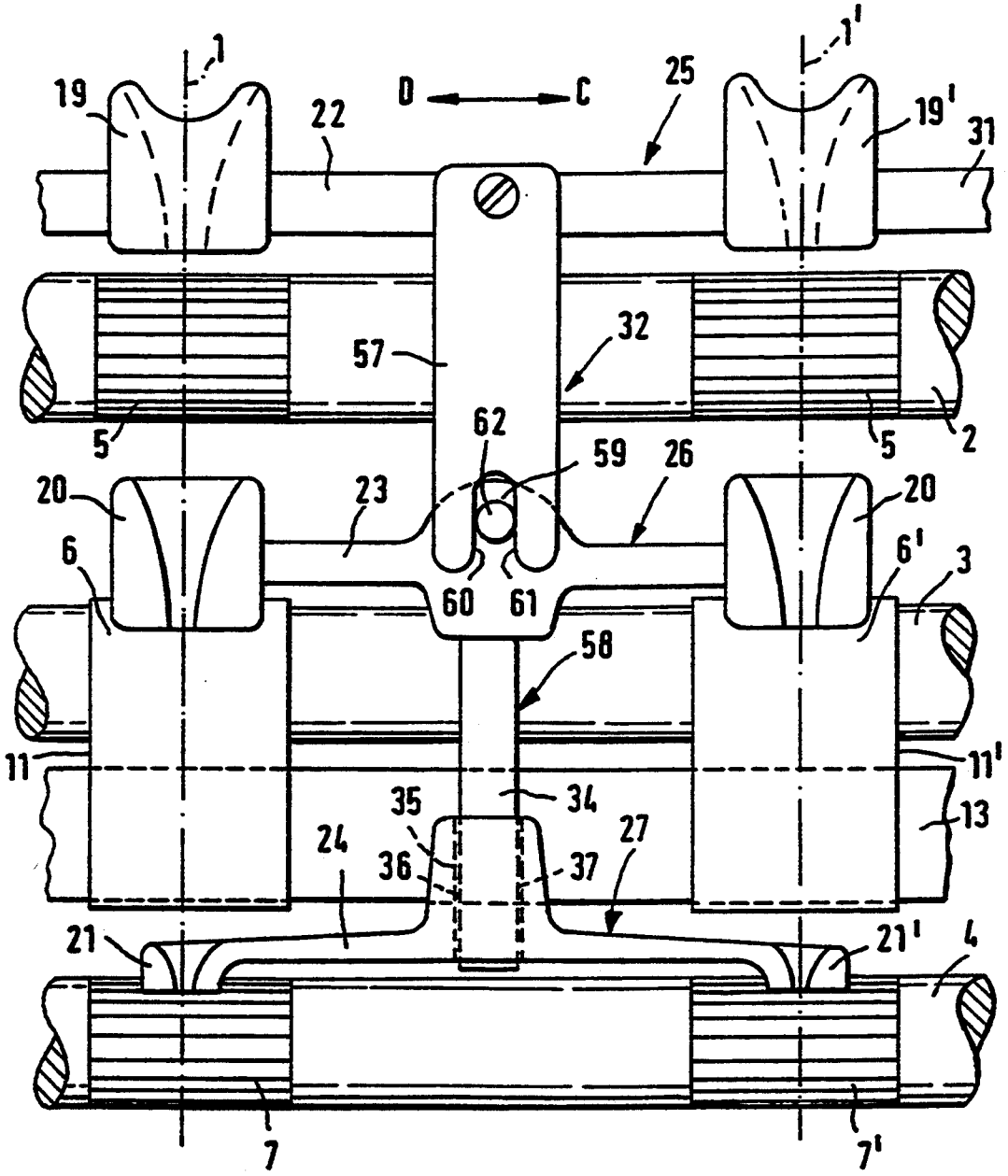
FIG. 12 is a view similar to FIG. 1 but rotated by 90 degrees, of an embodiment in which several coupling members are assigned to a driving device.

FIG. 12 illustrates a system in which the structural member 26 pertaining to bottom cylinder 3 as well as the structural member 27 pertaining to bottom cylinder 4 are guided corresponding to the invention.

The two sliver guides 20 and 20', which are assigned to the center zone of the drafting unit, are connected with one another by means of a coupling member 23 to form the structural member 26. In the same manner, the sliver guides 21 and 21' pertaining to the delivery clamping roller pair 18 are connected by the coupling member 24 to form structural member 27.

The structural member 27 has a recess 35 into which a bracket 34 of the driving device 32 engages by means of lateral guides 36 and 37. Since the sliver guides 21 and 21' are pulled into the wedge-shaped gap 30 because of the effect of the transport of the slivers 1, 1', the delivery clamping roller pair 18 determines the slideway for the structural member 27. This structural member 27 can be moved in the direction of the wedge-shaped gap 30 with respect to the driving device 32.

In this embodiment, the driving device is constructed in several parts. The driving device has a first driving part 57 as well as a second driving part 58 which contains the bracket 34. The first driving part 57 has a recess 59 with lateral guides 60 and 61 which come to rest against a pin-type extension 62 of the structural member 26 and therefore transfer the traversing movements to the sliver guides 20 and 20'. The structural member 26 is freely movable with respect to the driving device 32 in the direction of the wedge-shaped gap 29 of the clamping roller pair 17.

By means of the invention, tolerance-caused deviations of the parallelism of the traversing rod 31 from the respective clamping roller pair 16, 17 and 18 can be compensated. The parallelism with respect to the respective clamping roller pairs 16, 17 and 18 is achieved by the respective slideways. In addition, the free mobility of the structural members 26 and 27 relative to the driving device 32 is ensured in the direction of the wedge-shaped gaps 29 and 30.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A sliver guiding arrangement for drafting units of spinning machines comprising:

at least two silver guides which are assigned to two drafting units and are arranged upstream from a nip line of a roller pair;

a coupling member that connects the sliver guides to form a unit;

a driving device coupled to a traversing rod and to the coupling member; and a sliding surface on which the unit is guided in parallel to the nip line;

wherein the driving device bridges a distance between the traversing rod and the coupling member and is connected to the coupling member such that the coupling member moves together with the driving device in parallel to the nip line and is free for relative movement with respect to the driving device towards the roller pair.

2. An arrangement according to claim 1, further comprising a guide rail on which the sliding surface is arranged, the sliding surface being separated by a distance from the roller pair.

3. An arrangement according to claim 1, wherein the sliding surface is formed by at least one roller of the roller pair.

4. An arrangement according to claim 2, wherein the sliding surface is a stop against which the structural member is placed.

5. An arrangement according to claim 3, wherein the coupling member has at least two spacing webs which are placed against the roller.

6. An arrangement according to claim 1, wherein the driving device is arranged between two of the sliver guides and is non-slidably fastened to the traversing rod.

7. An arrangement according to claim 1, wherein the driving device has lateral guides that transmit the traversing movements to the coupling member.

8. An arrangement according to claim 7, wherein the driving device has a tongue-type bracket and the coupling member has a recess, and wherein the lateral guides are arranged on the tongue-type bracket and the bracket engages in the recess of the coupling member.

9. An arrangement according to claim 1, wherein the driving device is a leaf spring.

10. An arrangement according to claim 2, wherein the driving device rests against the guide rail with a contact pressure.

11. An arrangement according to claim 1, further comprising a plurality of coupling members coupled to the driving device.

12. An arrangement according to claim 1, wherein the driving device is held on the traversing rod so as to be foldable.

13. An arrangement according to claim 4, wherein the coupling member has at least two spacing webs which are placed against the roller.

14. An arrangement according to claim 3, wherein the driving device is arranged between two of the sliver guides and is non-slidably fastened to the traversing rod.

15. An arrangement according to claim 3, wherein the driving device has lateral guides that transmit the traversing movements to the coupling member.

16. An arrangement according to claim 2, wherein the driving device has lateral guides that transmit the traversing movements to the coupling member.

17. An arrangement according to claim 3, wherein the driving device is a leaf spring.

18. An arrangement according to claim 4, wherein the driving device rests against the guide rail with a slight contact pressure.

19. An arrangement according to claim 6, wherein the driving device rests against the guide rail with a slight contact pressure.

20. An arrangement according to claim 9, wherein the driving device rests against the guide rail with a slight contact pressure.

* * * * *